United States Patent [19]

Deitrich

[11] 3,977,681

[45] Aug. 31, 1976

[54] GAME USING A BOARD AND PLAYING PIECES

[75] Inventor: Jerry D. Deitrich, Rochester, N.Y.

[73] Assignee: The Raymond Lee Organization, Inc., New York, N.Y.

[22] Filed: Apr. 24, 1975

[21] Appl. No.: 571,226

[52] U.S. Cl. ..... 273/135 AC; 273/137 C

[51] Int. Cl.[2] ..... A63F 3/00

[58] Field of Search..... 273/130 R, 130 C, 130 F, 273/135 R, 135 AC, 137 R, 137 C, 137 D, 137 B

[56] References Cited

UNITED STATES PATENTS

| | | | |
|---|---|---|---|
| 2,571,195 | 10/1951 | Buck | 273/137 R |
| 2,782,039 | 2/1957 | Martin | 273/137 C |
| 3,674,274 | 7/1972 | Schur | 273/135 AC |
| 3,863,929 | 2/1975 | Kahan | 273/137 C |

*Primary Examiner*—Anton O. Oechsle
*Assistant Examiner*—Harry G. Strappello
*Attorney, Agent, or Firm*—Stephen Wyden

[57] ABSTRACT

A game for two players or teams using a 12 by 12 board and red, blue, and combination red and blue squares, the object of the game is to obtain the highest point score by having more of ones squares adjacent to squares of the same color than the opponent, 1 point being scored for each half edge continuous with the same color in the adjacent piece or playing base.

5 Claims, 7 Drawing Figures

GAME USING A BOARD AND PLAYING PIECES

I have invented a new and novel game called Marsahn for two players or two teams of players. A set of playing pieces and a playing board are used and the position of the pieces on the board determines the score.

The game, Marsahn, can be best understood by referring to the accompanying diagrams, in which.

Figure 5:
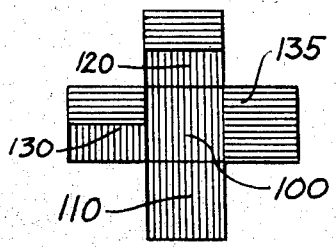
Figure 6:
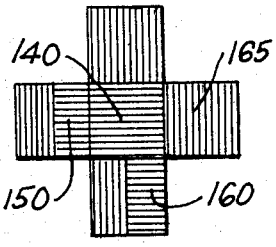
Figure 7:
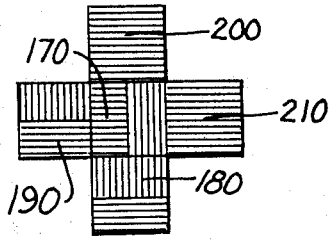

FIGS. 5, 6, and 7 illustrate scoring configurations of the playing pieces on the playing board.

Figure 1:
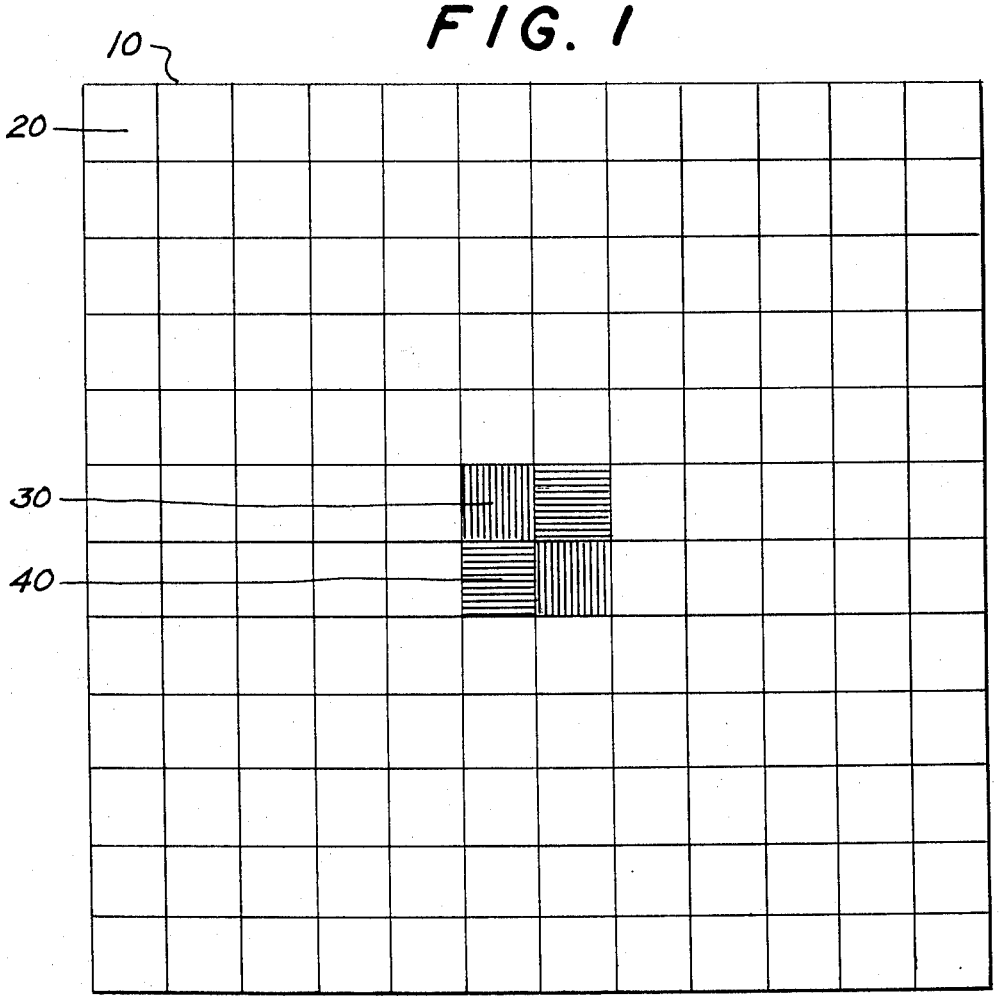
FIG. 1 illustrates the playing field.

In FIG. 1, we see that the playing field 10 consists of 144 squares 20 in a 12 × 12 square, each square being 1 × 1 in. The four centermost squares, called the playing base, are colored, two colored red 30 and two colored blue 40.

Figure 2:
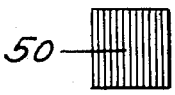
FIGS. 2, 3 and 4 illustrate the playing pieces.
Figure 3:
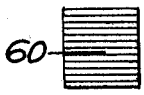

FIG. 2, shows a red playing piece 50 which is a square the same size as a square 20 of the playing board 10 illustrated in FIG. 1,

FIG. 3 shows a blue playing piece 60 of the same size as the red playing piece 50 of FIG. 2.

Figure 4:
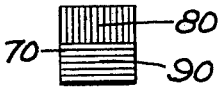

FIG. 4 shows a split 70, a playing piece that is half red 80 and half blue 90.

FIG. 5 illustrates the score arrangement when a red square 100 is closed. When each of the four edges of a piece are touched by other pieces, it, 100 is closed and the score is computed. One point is assigned when half an edge is in contact with the same color on the adjacent piece. There are potentially 8 points to a closed square. Here, the center piece 100 is touching two all red borders, 110 and 120, and one ½ red border 130, for a total of five half borders equal to 5 points. Since blue is not in contact with blue around the perimeter of the closed square, blue has a score of 0 points for this closed square. However, if Blue team had played a blue piece 135 to close the square 100, neither team would score because only the team that closes can receive closing points.

In FIG. 6, a blue piece, 140, is closed by 1½ edges of blue, 150 and 160, equal to 3 points. The red squares do not border red and red received 0 points. Again, if a red square 165 had closed the square 140, no closing points are earned by either team.

In FIG. 7, a split piece 170 is closed. Red is in contact with red on ½ edge 180 for 1 point and blue is in contact with blue on two half edges, 190 and 200, for 2 points, providing a split, 180 or 190 closed the split 170, or else blue 200 and 210, alone would score.

Play begins by placing a piece against the playing base formed by the two red 30 and the two blue 40 squares, and all pieces are selected by the players by a random means. All pieces are placed against The base of another piece. When a piece is placed against another of the same color at the contact edge, one point is scored for each half edge of contact for the color of the playing team or for both teams if a split is played. The score is also computed when a piece is closed. There are 30 red, 30 blue, and 50 split pieces, 50, 60, and 70.

The game is completed when all the pieces are played or when an agreed upon time or point limit has been reached.

Having described a preferred embodiment of my invention, it is understood that various changes can be made without departing from the spirit of my invention, and I desire to cover by the appended claims, all such modifications as fall within the true spirit and scope of my invention.

What I claim and seek to secure by Letters Patent is:

1. A game, comprising;

a board, comprising 144 squares, each 1 inch square, forming a 12 × 12 square array, a playing base formed on the board by coloring the center most four squares alternately red and blue, playing pieces, each 1 inch square, of solid red, playing pieces, each 1 inch square, of solid blue and, playing pieces, each 1 inch square, of red and blue, wherein each color covers a ½ × 1 inch rectangular area of the piece.

2. The game, of claim 1, wherein the pieces comprise:

30 red playing pieces, 30 blue playing pieces, and 50 red and blue playing pieces.

3. The game, of claim 1, wherein the scoring comprises:

closing points to the team whose color square closes a square, closing points to both teams when a split closes a square, points awarded to the team which places a piece of its color adjacent the same color square, and points awarded to both teams when a split is placed adjacent to other squares.

4. The game, of claim 1, which is played by a player randomly choosing a piece and placing the piece on the board adjacent to another piece or adjacent to the playing base, until the game is completed.

5. The game, of claim 4, is completed when one of the following occurs:

all pieces are used up, an agreed upon point limit is reached, or an agreed upon time limit is reached.

* * * * *